US009206953B2

(12) United States Patent
Roos

(10) Patent No.: US 9,206,953 B2
(45) Date of Patent: Dec. 8, 2015

(54) LIGHTING ASSEMBLY AND METHOD

(75) Inventor: Paul Jan Roos, Bulli (AU)

(73) Assignee: KLIK SYSTEMS AUSTRALIA PTY LTD, Eastern Creek (AU)

( * ) Notice: Subject to any disclaimer, the term of this patent is extended or adjusted under 35 U.S.C. 154(b) by 385 days.

(21) Appl. No.: 13/807,525

(22) PCT Filed: Mar. 9, 2011

(86) PCT No.: PCT/AU2011/000263
§ 371 (c)(1),
(2), (4) Date: Mar. 11, 2013

(87) PCT Pub. No.: WO2012/000012
PCT Pub. Date: Jan. 5, 2012

(65) Prior Publication Data

US 2013/0201665 A1 Aug. 8, 2013

(30) Foreign Application Priority Data

Jun. 29, 2010 (AU) ..... 2010902861

(51) Int. Cl.
*F21S 8/00* (2006.01)
*F21S 8/02* (2006.01)
*E04F 11/18* (2006.01)
(Continued)

(52) U.S. Cl.
CPC ..... *F21S 8/02* (2013.01); *E04F 11/1817* (2013.01); *F21V 5/08* (2013.01); *F21V 21/04* (2013.01); *F21V 33/006* (2013.01); *E04F 2011/1872* (2013.01); *F21V 5/04* (2013.01); *F21V 29/004* (2013.01); *F21V 29/70* (2015.01); *F21W 2111/08* (2013.01); *F21Y 2101/02* (2013.01)

(58) Field of Classification Search
CPC ..... F21V 33/006; F21V 21/02
USPC ..... 362/145–147, 152, 109
See application file for complete search history.

(56) References Cited

U.S. PATENT DOCUMENTS 3,740,541 A 6/1973 Conradt
4,161,769 A 7/1979 Elliott
(Continued)

FOREIGN PATENT DOCUMENTS

DE 4421781 1/1996
DE 102005041333 1/2007
(Continued)

OTHER PUBLICATIONS

European Patent Office, Communication in corresponding European application, Jan. 8, 2014.
(Continued)

*Primary Examiner* — William Carter
(74) *Attorney, Agent, or Firm* — Wood, Herron & Evans, LLP

(57) ABSTRACT

A lighting assembly for installing through a fitting aperture defined by a handrail. The lighting assembly including: a retaining element that is removably insertable through the fitting aperture; a body device for providing a light source, the body device comprising a coupling element releasably engageable to the retaining element; and wherein, with the retaining element inserted through the fitting aperture and located within the handrail, insertion of the body device through the fitting aperture enables the coupling element to engage the retaining element thereby releasably retaining the body device.

16 Claims, 19 Drawing Sheets

(51) Int. Cl.

| | |
|---|---|
| ***F21V 5/08*** | (2006.01) |
| ***F21V 21/04*** | (2006.01) |
| ***F21V 33/00*** | (2006.01) |
| *F21V 29/00* | (2015.01) |
| *F21Y 101/02* | (2006.01) |
| *F21V 5/04* | (2006.01) |
| *F21W 111/08* | (2006.01) |
| *F21V 29/70* | (2015.01) |

(56) References Cited

U.S. PATENT DOCUMENTS

| | | | | |
|---|---|---|---|---|
| 4,367,517 | A * | 1/1983 | Balzer | 362/146 |
| 6,145,996 | A | 11/2000 | Shimada | |
| 2008/0080173 | A1 * | 4/2008 | Trimble et al. | 362/146 |
| 2008/0304253 | A1 | 12/2008 | Handsaker | |
| 2010/0053950 | A1 | 3/2010 | Higuchi et al. | |
| 2011/0090680 | A1 * | 4/2011 | Steinkraus | 362/217.05 |

FOREIGN PATENT DOCUMENTS

| | | | |
|---|---|---|---|
| DE | 202008004620 | | 7/2008 |
| EP | 1724516 | | 11/2006 |
| EP | 1918480 | | 9/2007 |
| EP | 1918480 | A2 | 5/2008 |
| GB | 2372091 | | 4/2002 |
| JP | 2005248423 | | 9/2005 |
| WO | 2007/006130 | A1 | 1/2007 |

OTHER PUBLICATIONS

Australian Patent Office, Patent Examination Report in corresponding application, Feb. 7, 2014.

Australian Patent Office, International Search Report in corresponding PCT Application No. PCT/AU2011/000263 mailed May 6, 2011, 3 pp.

Espacenet, EPO English Machine Translation of Application No. EP 1918480 (A2), Published May 7, 2008, http://worldwide.espacenet.com, retrieved on Dec. 28, 2012, 5 pp.

* cited by examiner

936

LIGHTING ASSEMBLY AND METHOD

This application claims priority, under Section 371 and/or as a continuation under Section 120, to PCT Application No. PCT/AU2011/000263, filed on Mar. 9, 2011, which claims priority to Australian Application No. 2010902861, filed on Jun. 29, 2010.

FIELD OF THE INVENTION

The present invention relates to lighting sources and in particular to lighting assemblies.

The invention has been developed primarily for use as an light emitting diode (LED) lighting assembly for installing into a handrail and will be described hereinafter with reference to this application. However, it will be appreciated that the invention is not limited to this particular field of use.

BACKGROUND OF THE INVENTION

Any discussion of the prior art throughout the specification should in no way be considered as an admission that such prior art is widely known or forms part of the common general knowledge in the field.

Known lighting assemblies for installing into a handrail typically require a fastening element to be fixed to the handrail for retaining the assembly. This fixing of a fastening element is time consuming.

Lighting assemblies installed in handrails typically are configured to illuminate directly below the handrail, which throws a substantial portion of the light to the wall adjoining the handrail. To overcome this, a handrail is typically rotated such that the light is directed toward the centre of a respective thoroughfare. However this rotation can cause the light source to come into a direct line-of-sight of passers-by, thereby resulting in undesirable light glare.

OBJECT OF THE INVENTION

It is an object of the present invention to overcome or ameliorate at least one of the disadvantages of the prior art, or to provide a useful alternative.

It is an object of the invention in a preferred form to provide a lighting assembly that can be installed into a handrail.

It is an object of the invention in a preferred form to provide a lighting assembly that, when installed in a handrail, provides directed illumination. Preferably, this lighting assembly directs light toward a thoroughfare and away from a wall adjoining the handrail.

SUMMARY OF THE INVENTION

According to an aspect of the invention there is provided a lighting assembly for installing through a fitting aperture defined by a handrail, the lighting assembly including:

- a retaining element that is removably insertable through the fitting aperture;
- a body device for providing a light source, the body device comprising a coupling element releasably engageable to the retaining element; and
- wherein, with the retaining element inserted through the fitting aperture and located within the handrail, insertion of the body device through the fitting aperture enables the coupling element to engage the retaining element thereby releasably retaining the body device.

Preferably, with the body device inserted through fitting aperture and retained by the retaining element, the light source provides an asymmetric illumination pattern.

According to an aspect of the invention there is provided a lighting assembly for installing through a fitting aperture defined by a handrail, the lighting assembly including:

- a retaining element;
- a body device for providing a light source;
- wherein, with the body device inserted through fitting aperture and retained by the retaining element, the light source provides an asymmetric illumination pattern.

According to an aspect of the invention there is provided a lighting assembly for installing through a fitting aperture defined by a handrail, the lighting assembly including:

- a retaining element that is removably insertable through the fitting aperture; and
- a body device for providing an asymmetric light source, the body device comprising a coupling element releasably engageable to the retaining element.

According to an aspect of the invention there is provided a lighting assembly for installing through a fitting aperture defined by a handrail, the lighting assembly including:

- a retaining element that is removably insertable through the fitting aperture;
- a body device for providing a light source, the body device comprising a coupling element releasably engageable to the retaining element; and
- wherein, with the retaining element inserted through the fitting aperture and located within the handrail, insertion of the body device through the fitting aperture enables the coupling element to engage the retaining element thereby releasably retaining the body device.

According to an aspect of the invention there is provided a lighting assembly for installing through a fitting aperture defined by a handrail, the lighting assembly including:

- a retaining element;
- a body device for providing a light source;
- wherein, with the body device inserted through fitting aperture and retained by the retaining element, the light source provides an asymmetric illumination pattern.

Preferably, the retaining element is elongate and sized to circumferentially abut a portion of an interior of the handrail. More preferably, opposite end portions of the retaining element abuttingly engages an abutment surface defined by the coupling element for retaining the body device. Most preferably, the opposite end portion of the retaining element abuttingly engages a stop for restricting further entry of the body device through the fitting aperture.

Preferably, the retaining element is biased into a retaining configuration. More preferably, the retaining element comprises spring steel. Alternatively, the retaining element comprises injection moulded plastics.

Preferably, the coupling element defines an abutment surface for engaging the retaining element and thereby retaining the body device. More preferably, the coupling element is defined by a pair of groves on opposite sides of the body device. Alternatively coupling element is defined by a pair of flange protrusions on opposite sides of the body device. Most preferably, the body device has an expanding taper for directing the retaining element into an expanded configuration for receiving the body device, and enabling a retaining configuration upon engagement with the coupling element.

Preferably, the body device includes a stop for restricting further entry of the body device through the fitting aperture. More preferably, the stop is adapted to abuttingly engage opposite end portion of the retaining element. Most preferably, the stop is adapted to restrict movement of the body device, when the body device is substantially flush with the exterior of the handrail.

Preferably, the body device is removable from the handrail. More preferably, the body device can be disengaged from the retaining element by relative rotation of the body device with respect to the retaining element and/or handrail, thereby enabling removal of the body device from the handrail. Most preferably, with the body device disengaged from the retaining element, a stop restricts further entry of the body device through the fitting aperture.

Preferably, relative rotation of the body device with respect to the retaining element, moves the retaining element out of coupling configuration, thereby enabling removal of the body device from the handrail. More preferably, a stop restricts further entry of the body device through the fitting aperture. Most preferably, the retaining element can be withdrawn through the aperture.

Preferably, the body device comprises:

a base element;

a heat sink element;

an light emitting diode (LED) light source; and a lens element.

Preferably, the lens element is adapted to be held within the base. More preferably, the light source is adapted to be held within the heat sink element. Most preferably, the body device is formed by fixing the heat sink element to the base element.

Preferably, the lens element is asymmetric with respect to an axis of insertion. More preferably, the lens directs light asymmetrically about the axis. Most preferably, when the body device is installed in a handrail in a substantially downward orientation, the lens directs light asymmetrically toward a thoroughfare and away from a wall adjoining the handrail.

Preferably, the light source is mounted at an angle offset to an axis of insertion. More preferably, the light source is mounted to the heat sink at an angle offset to the axis of insertion. Most preferably, when the body device is installed in a handrail in a substantially downward orientation, the lens directs light toward a thoroughfare and away from a wall adjoining the handrail.

Preferably, the axis of insertion is defined through a centre of base and heat sink when viewed as a side profile. When the body device is in installed in a handrail, the axis of insertion is preferably substantially vertical. Preferably, the base is a cylindrical section having an axis that defines the axis of insertion.

Preferably, the heat sink has a coupling element that defines an abutment surface for engaging the retaining element. More preferably, the heat sink defines a stop for restricting further entry of the body device through the fitting aperture. Alternatively, the base defines a stop for restricting further entry of the body device through the fitting aperture.

Preferably, the base has a coupling element that defines an abutment surface for engaging the retaining element. More preferably, the base defines a stop for restricting further entry of the body device through the fitting aperture. Alternatively, the heat sink defines a stop for restricting further entry of the body device through the fitting aperture.

BRIEF DESCRIPTION OF THE DRAWINGS

A preferred embodiment of the invention will now be described, by way of example only, with reference to the accompanying drawings in which.

PREFERRED EMBODIMENT OF THE INVENTION

Figure 1:
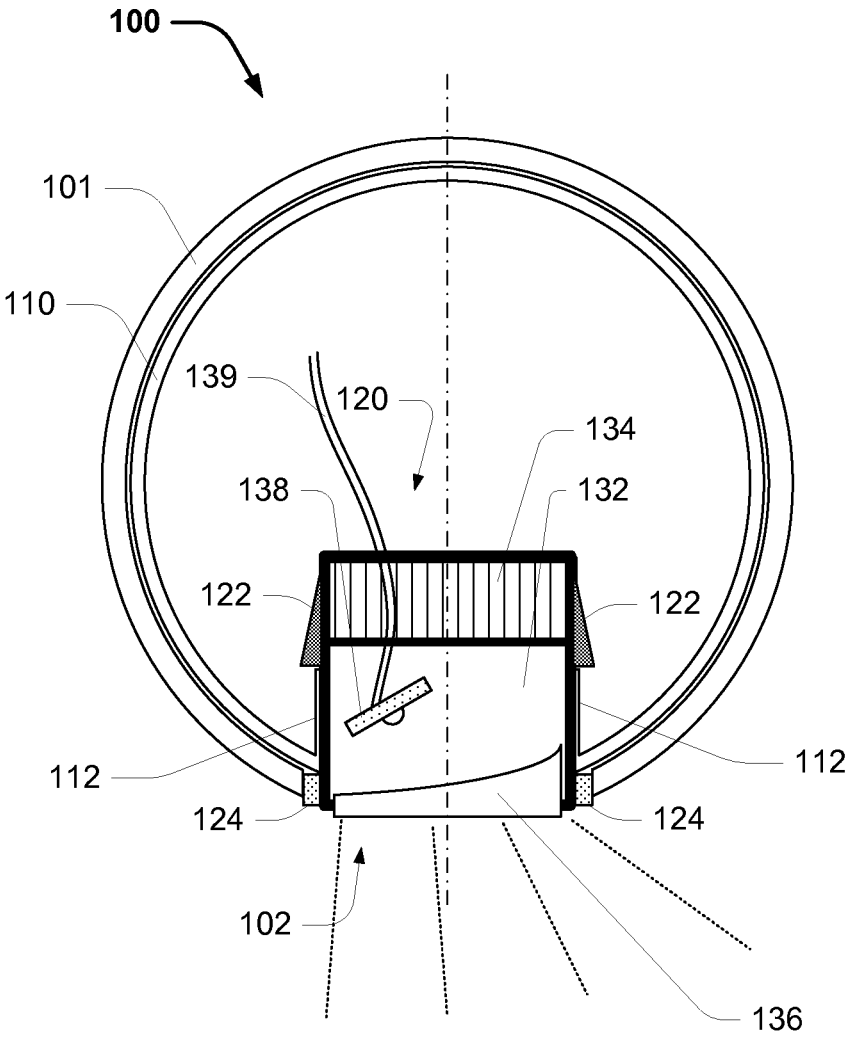
FIG. 1 is a schematic view of a lighting assembly according to the invention, shown installed in a handrail.

Referring to the drawings, there are disclosed embodiment lighting assemblies that can be installed into a handrail. Wherein, in an example embodiment, this lighting assembly can provide asymmetrical illumination.

FIG. 1 shows a schematic view of an embodiment lighting assembly 100 installed in a handrail 101. The lighting assembly 100 is installed through a fitting aperture 102 defined by the handrail 101.

The lighting assembly 100 includes a retaining element 110 in the form of an elongate arcuate band 110 and a body device 120 for providing a light source. The retaining element comprises opposite end portions 112 for abuttingly engaging the body device. The body device comprises a pair of corresponding coupling elements 122, which are releasably engagable to the retaining element.

The body device further includes one or more stops 124 for restricting further entry of the body device through the fixture aperture. This stop 124 can abuttingly engage the opposite end portions of the retaining element.

In this example embodiment the body device comprises a base element 132, a heat sink element 134, a lens element 136, and an light emitting diode (LED) light source 138. The light source 138 is electrically coupled to a power source 139.

This embodiment lighting assembly 100 can be installed through an fitting aperture 102 defined by a handrail 101.

By way of example, the lighting assembly includes: a retaining element 110 that is removably insertable through the fitting aperture; a body device 120 for providing a light source, the body device comprising a coupling element releasably engageable to the retaining element; and wherein, with the retaining element inserted through the fitting aperture and located within the handrail, insertion the body device through the fitting aperture enables the coupling element to engage the retaining element thereby releasably retaining the body device.

By way of example, the lighting assembly includes: a retaining element 110; a body device 120 for providing a light source; wherein, with the body device inserted through fitting aperture and retained by the retaining element, the light source provides an asymmetric illumination pattern.

Figure 2:
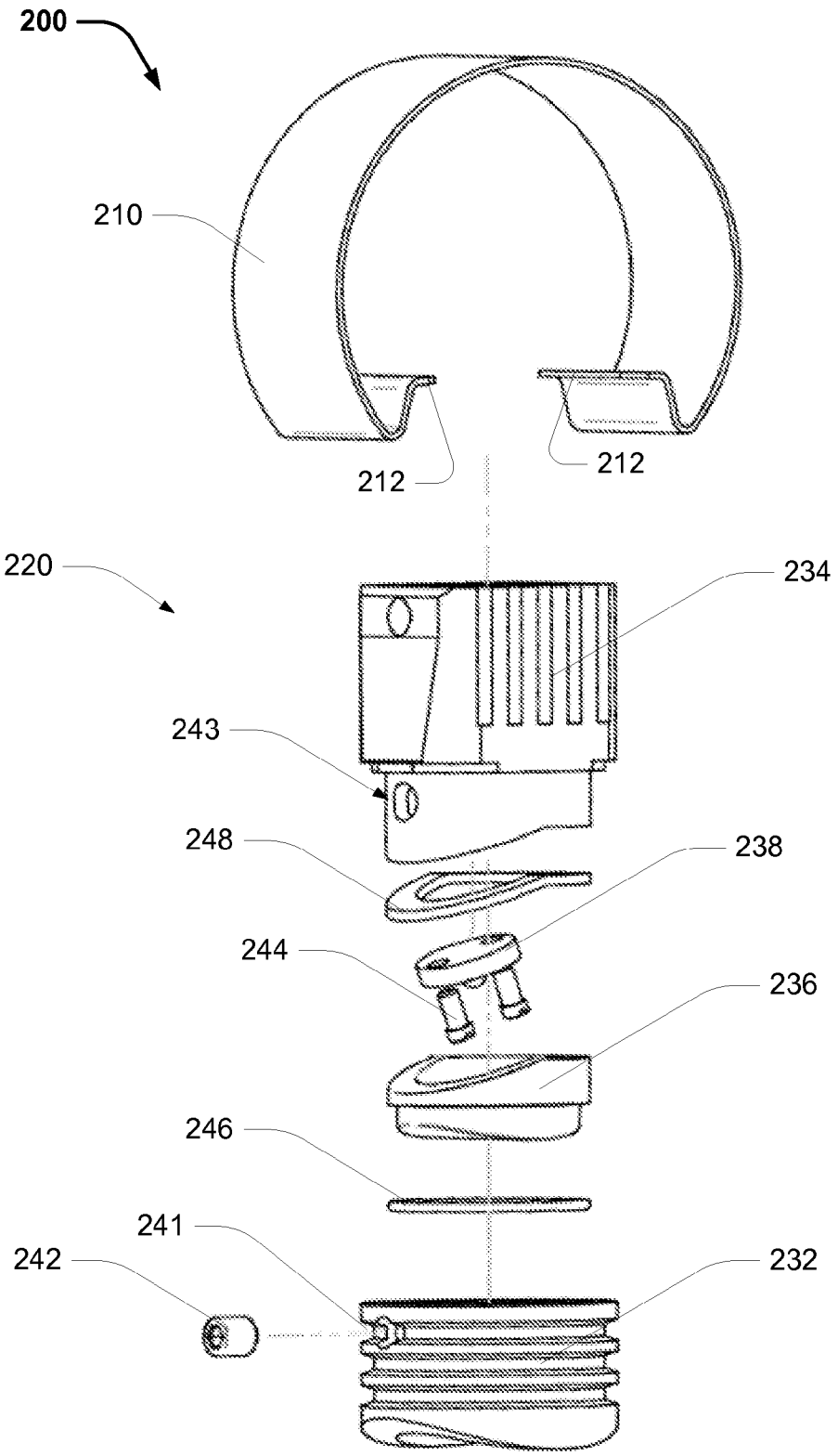
FIG. 2 is an inline assembly view of an embodiment lighting assembly according to the invention.

Referring to FIG. 2, an embodiment lighting assembly 200 is disclosed. This embodiment lighting assembly can be installed through a fitting aperture defined by a handrail. While this embodiment was developed for use with 50.8 mm diameter stainless steel handrail having a 1.6 mm wall thickness, it will be appreciated that it is not limited to this particular use.

This embodiment lighting assembly 200 includes:

a body device 220 for providing a light source; and a retaining element 210 comprising opposite end portions 212 for abuttingly engaging and retaining the body device.

The body device 220 comprises a base element 232, a heat sink element 234, lens element 236, and a light emitting diode (LED) light source 238. The light emitting diode (LED) light source 238 is electrically coupled to a power source (not shown).

In this embodiment body device 220, the lens element 236 is adapted to be held within the base element 232, and the light source 238 is adapted to be held within the heat sink 234. The body device is then formed by fixing the heat sink to the base.

Assembly of the body device 220 involves a plurality of components. The light source 238 is fastened to the a heat sink element 234 by screws 244. An lens element 236 and O ring 246 are placed within the base element 232, the O ring supporting the lens element. The base element 232 and heat sink element 234 are brought together, with an ethylene propylene diene monomer (EPDM) gasket between, and fastened by a grub screw located by apertures 241 and 243.

In this embodiment a side cross section of the lens element 236 is asymmetric with respect to a central axis, such that when the body device is installed in a handrail in a substantially downward orientation, the lens can directs light asymmetrically toward a thoroughfare and away from a wall adjoining the handrail.

In this embodiment, light source 238 is mounted at an angle to the horizontal, as viewed in a direction along the handrail. By way of example only, the light source 238 throws light in a direction substantially perpendicular to the angle defined by the mount. It would be appreciated that, in an alternative example embodiment, a lens element can contribute to an asymmetric throw of light, while an LED light source is mounted substantially horizontally and throwing light in a substantially downward orientation.

Figure 3A:
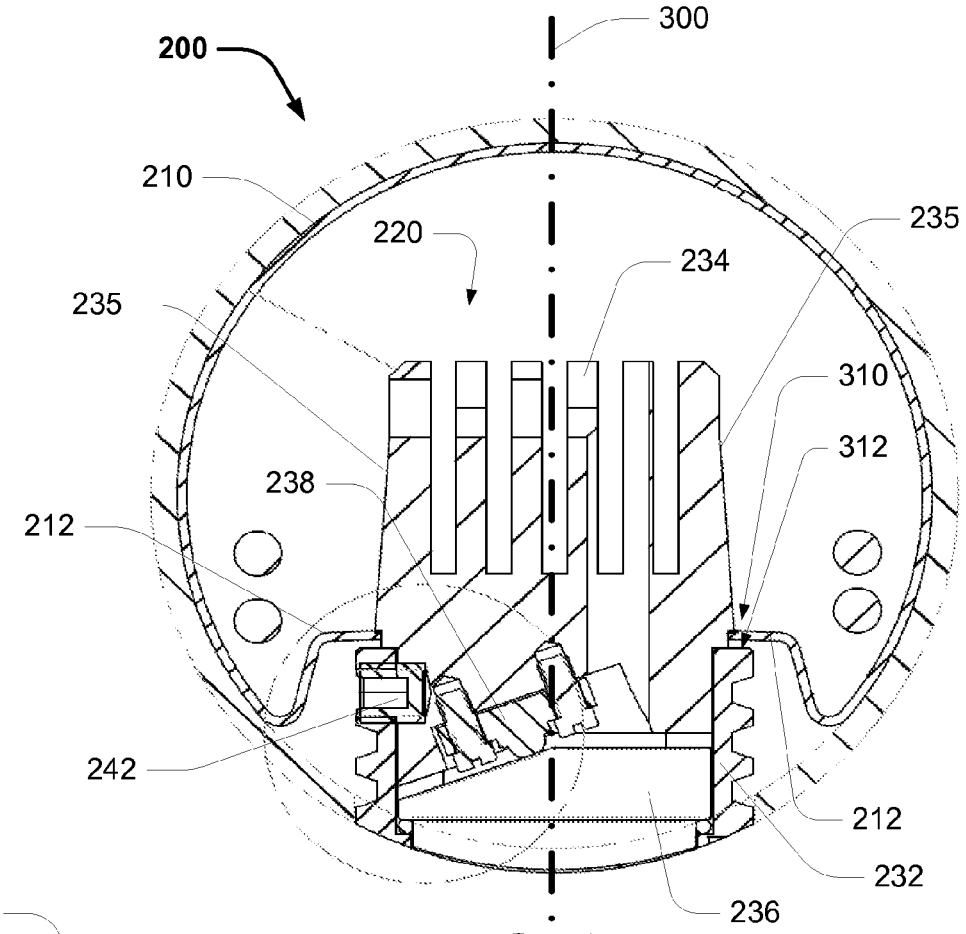
FIG. 3A is a cross sectional side view of the lighting assembly of FIG. 2, shown installed in a hand rail.
Figure 3B:
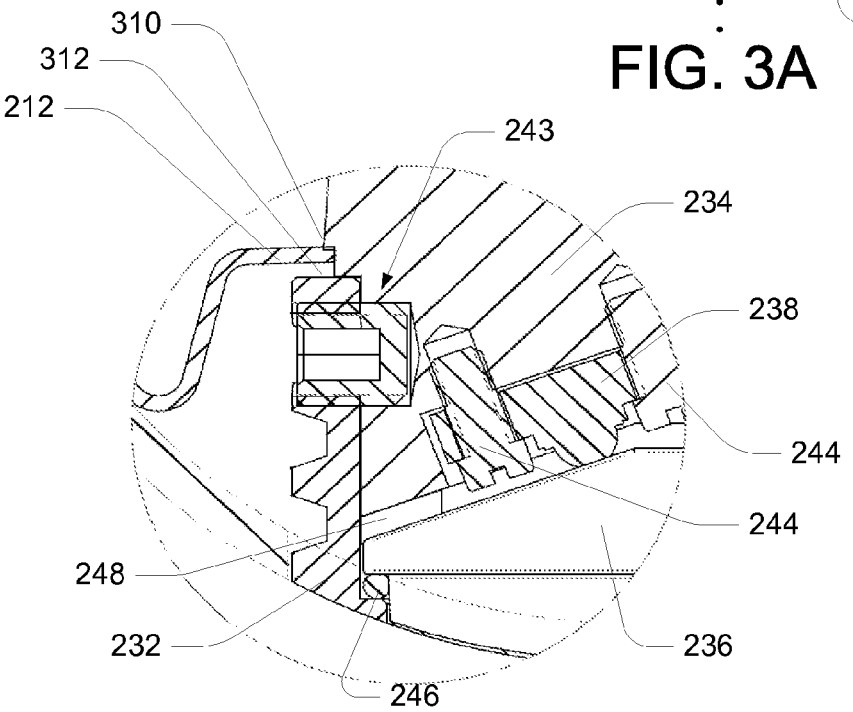
FIG. 3B is an enlarged sectional view of the lighting assembly of FIG. 3A, showing the retaining element retaining the body device within the hand rail.
Figure 3C:
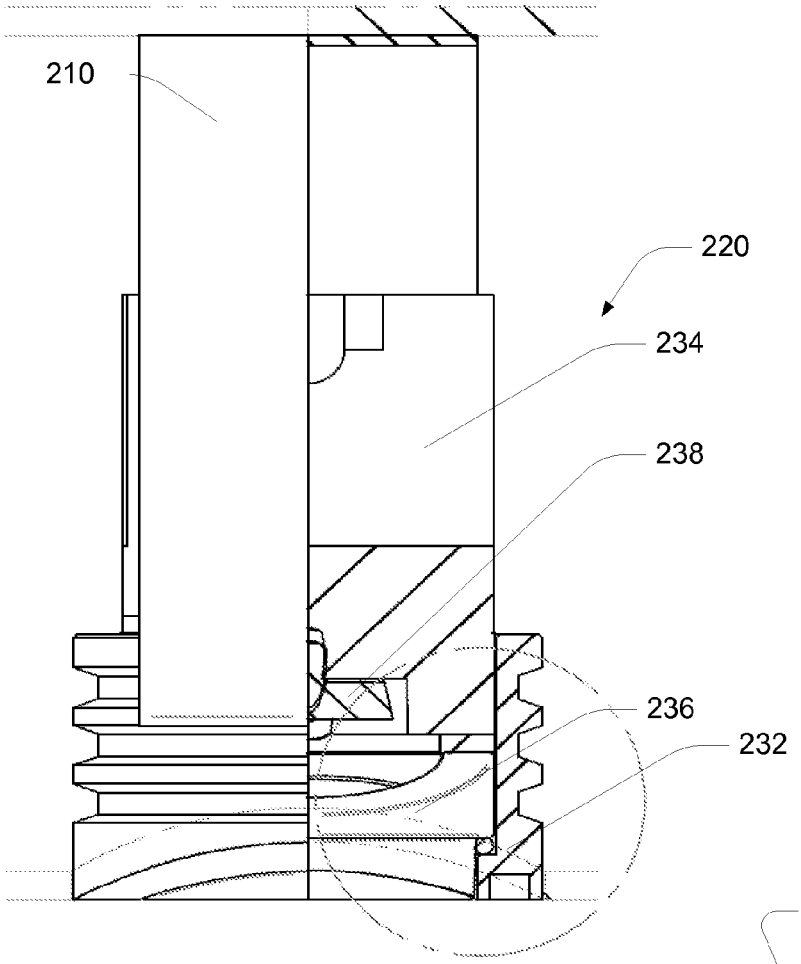
FIG. 3C is a partial sectional front view of the lighting assembly of FIG. 2.
Figure 3D:
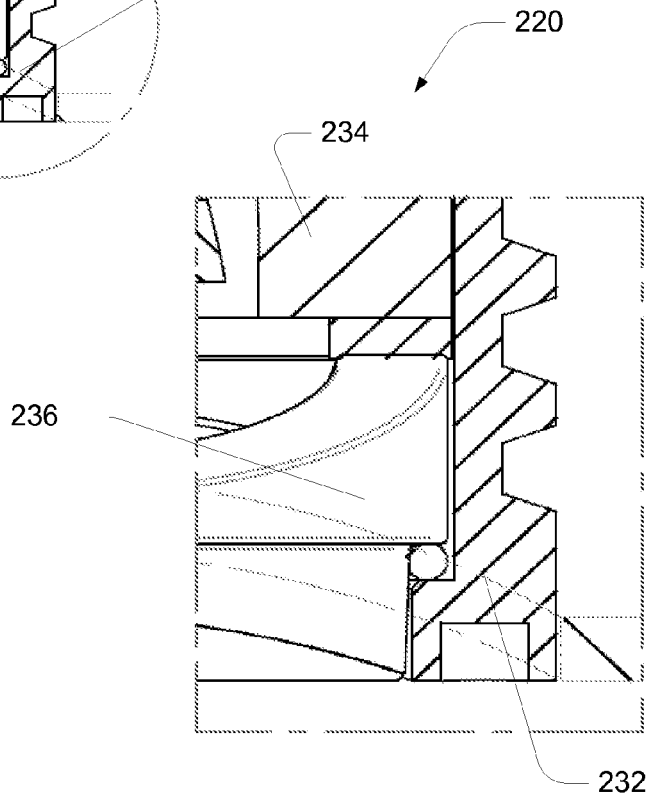
FIG. 3D is an enlarged sectional view of the lighting assembly of FIG. 3C.

Referring to FIG. 3A and FIG. 3B, an axis of insertion 300 is defined through a centre of base and heat sink. When the body device is in installed in a handrail, the axis of insertion is substantially vertical. It will be appreciated that, in this embodiment, the base element is a cylindrical section having an axis that defines the axis of insertion.

It will be appreciated that the axis of insertion is preferably defined through the centre of base and heat sink, when viewed from the side. When the body device is in installed in a handrail, the axis of insertion substantially vertical. The handrail is typically a cylindrical conduit and the axis of insertion of the body device preferably defines a substantially vertical diametric cord with respect to the circular cross section of the handrail.

Figure 6A:
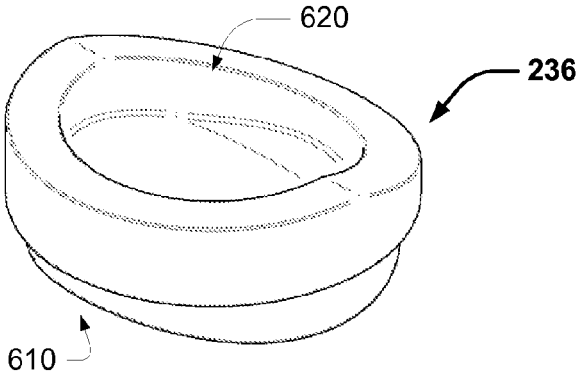
FIGS. 6A-6L show views of the lens element of the lighting assembly of FIG. 2.
Figure 6B:
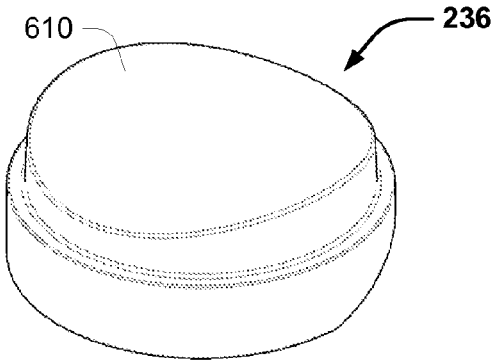
Figure 6C:
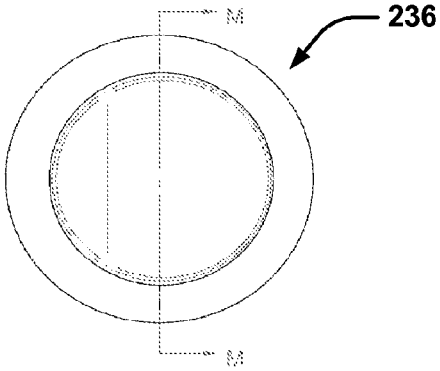
Figure 6G:
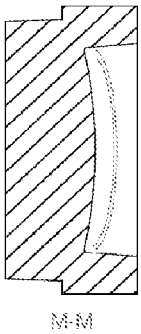
Figure 6D:
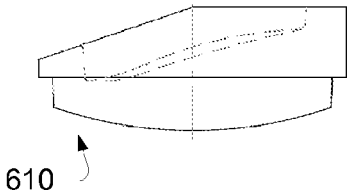
Figure 6F:
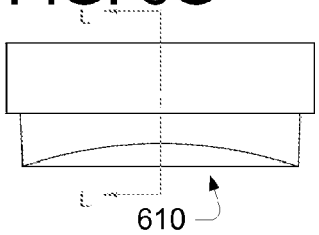
Figure 6E:
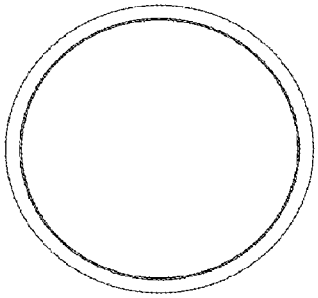
Figure 6H:
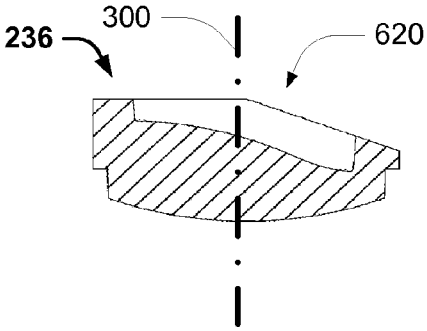
Figure 6K:
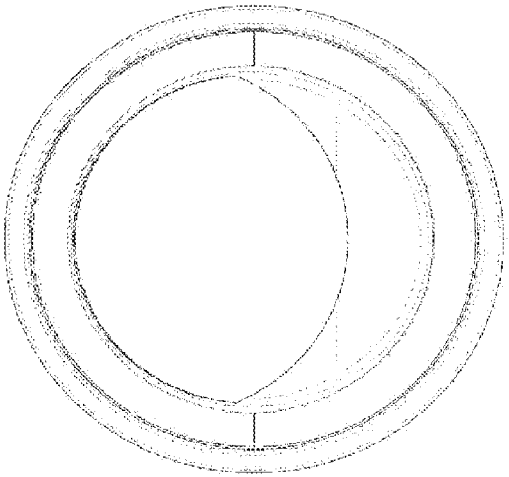
Figure 6I:
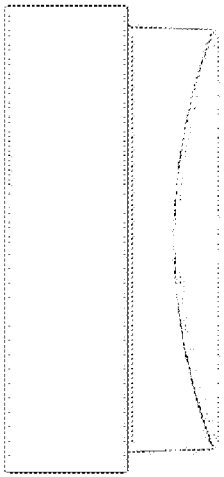
Figure 6J:
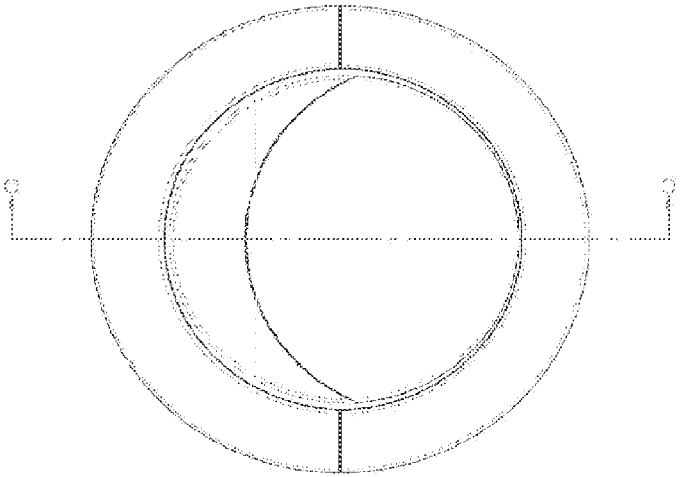
Figure 6L:
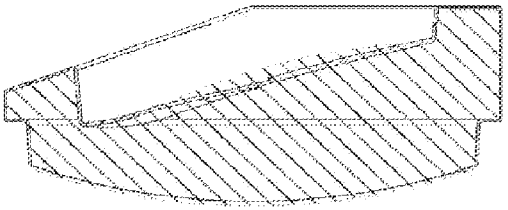

In this embodiment (as best shown in FIG. 6H) a side cross section of the lens element 236 is asymmetric with respect to an axis of insertion 300. The lens is adapted to direct light asymmetrically about the axis, such that when the body device is installed in a handrail in a substantially downward orientation, the lens can direct light asymmetrically toward a thoroughfare and away from a wall adjoining the handrail.

The led light source 238 is mounted to the heat sink at an angle offset to the axis of insertion. It will be appreciated that, when the body device is installed in a handrail in a substantially downward orientation—as shown in FIG. 3A, the combination of the light source 238 and lens element 236 can directs light toward a thoroughfare and away from a wall adjoining the handrail.

It will be apperceived that, both asymmetry of the lens element 236 and the angle of the 238 are for the purpose of forming an asymmetric illumination distribution with respect to at least one plane, such that the body device can be installed in a substantially downward orientation—as shown in FIG. 3A for directing light asymmetrically with respect to a vertical plane 300 extending through the device. Typically, the body device is installed such that the vertical plane is parallel with a wall adjoining the handrail for providing greater illumination toward a thoroughfare, than illumination directed toward the wall. It will be appreciated that the axis of insertion can lie within the plane.

The retaining element 210 is an arcuate elongate band sized to be inserted through the fitting aperture and adapted to circumferentially abut a portion of an interior of the handrail. The retaining element comprises spring steel (or e.g. a resilient polymer) and is biased into a retaining configuration.

To install the body element, the retaining element 210 is first inserted through the fitting aperture, with the opposite end portions 212 aligned with opposite sides of the fitting aperture. The body device can then be orientates such that the coupling elements align with the opposite end portions 212, and the body device inserted through the fitting aperture until the retaining element engages the coupling element 310.

Referring to FIG. 3B, opposite end portions 212 define a abutment flanged surface for retaining the body device within a handrail. Upon insertion of the body device, tapered sides 235 heat sink 234 direct the retaining element into an expanded configuration for receiving the body device, and enable return to the retaining configuration upon engagement with the coupling element 310. The opposite end portions 212 of the retaining element 210 engages an abutment surface 310 defined by heat sink, thereby retaining the body device. This restricts withdrawal of the body device from the handrail.

It will be appreciated that alternative coupling element can be used, including abutment surface defined by a pair of grooves on opposite sides of the body device; or a pair of flange protrusions on opposite sides of the body device. By way of example only, the heat sink or base can define either the coupling element or the stop surface.

A stop abutment surface 312 is also provided to restrict further entry of the body device through the fitting aperture. In this embodiment the opposite end portions 212 of the retaining element abuttingly engages the stop surface 312 defined by the perimeter of the base element 232. The stop is adapted to restrict movement the body device, when the body device is substantially flush with the exterior of the handrail.

In this embodiment, the top surface of opposite end portions 212 define a flanged surface for abutting the coupling element 310 for retaining the body device within a handrail, and the under surface of opposite end portions 212 abut a stop abutment surface 312 for restricting further entry of the body device through the fitting aperture.

To remove the body device 220 from the handrail, the body device undergoes a 90 degree "quarter turn". As the body device is rotated, the retaining element 210 disengages the abutment surface 310, allowing the body device to be withdrawn from the handrail. It will be appreciated that the stop surface 312, defined by the circular perimeter of the base element 232 continues, continues to abut the opposite end portions 212 of the retaining element to restrict further entry of the body device through the fitting aperture.

Figure 4A:
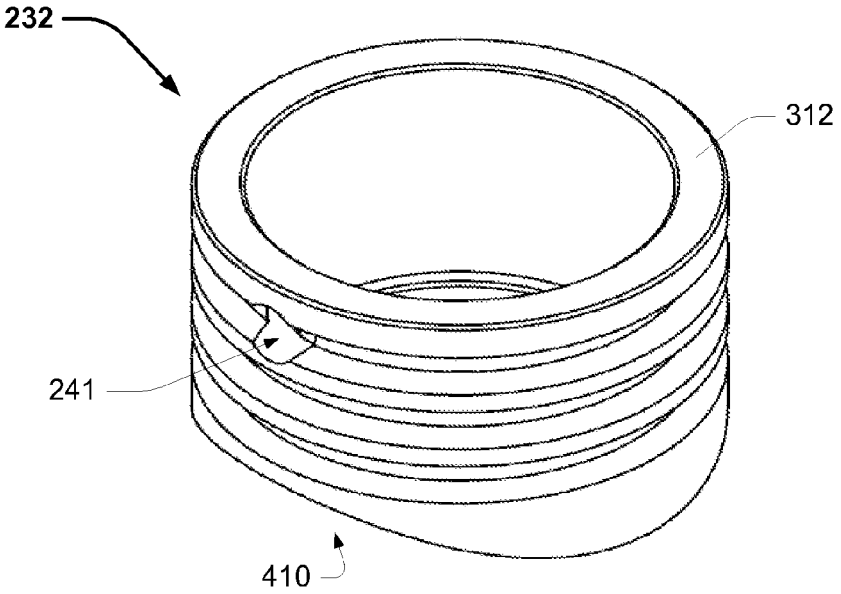
FIGS. 4A-4H show views of the base element of the lighting assembly of FIG. 2.
Figure 4B:
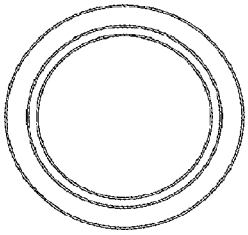
Figure 4G:
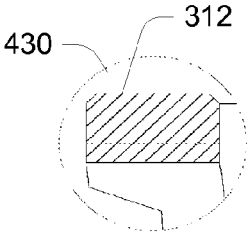
Figure 4C:
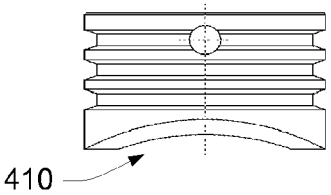
Figure 4D:
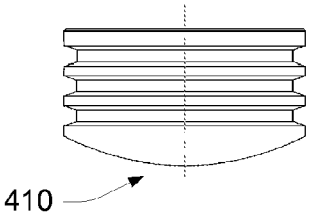
Figure 4E:
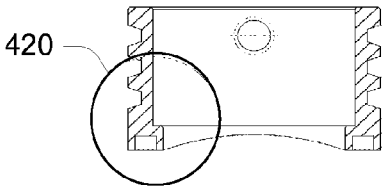
Figure 4F:
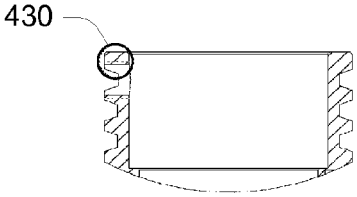
Figure 4H:
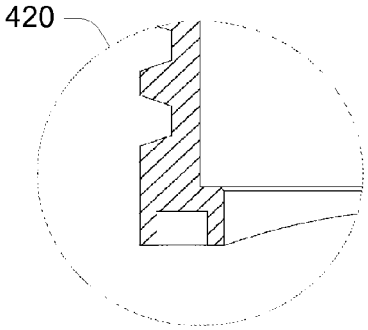

FIG. 4A through FIG. 4H show the base element 232 of a lighting assembly, being a sustainably cylindrical. The lower portion 410 of the base element 232 is defined by the intersection of the cylindrical base with the handrail, when the body device is installed. This conforms the body device to the handrail, when installed. FIG. 4C shows a font elevation view of the base element 232 and FIG. 4D shows a side elevation view of the base element 232. Sectional views are provided by FIG. 4E through FIG. 4H.

It will be appreciated that as the base element is substantially cylindrical and defines the stop means 312, applying a quarter turn rotation does not disengage the stop means from the retaining element and continues to restrict further entry of the body device through the fitting aperture.

Figure 5A:
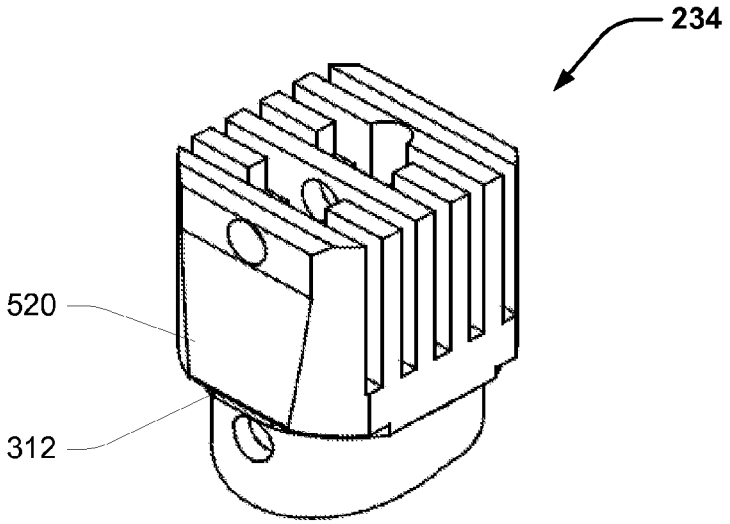
FIGS. 5A-5F show views of the heat sink element of the lighting assembly of FIG. 2.
Figure 5E:
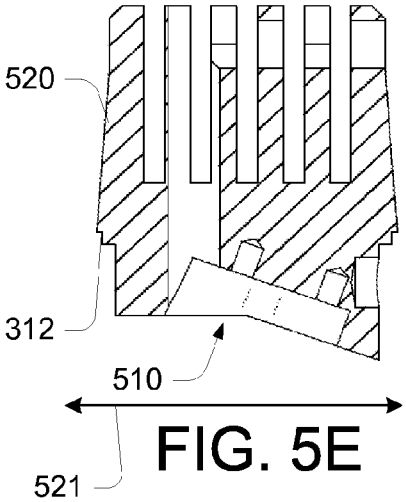
Figure 5B:
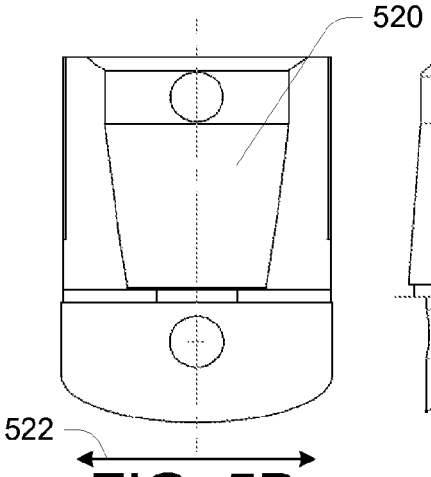
Figure 5C:
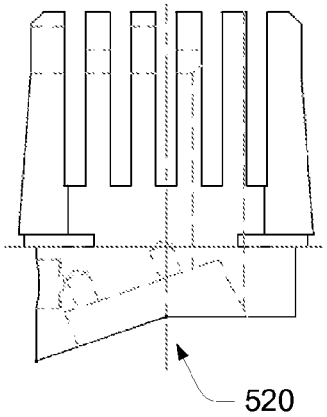
Figure 5F:
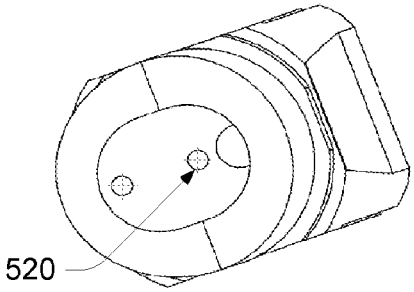
Figure 5D:
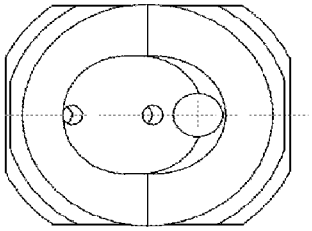

FIG. 5A through FIG. 5F show the heat sink element 234 of a lighting assembly. A base recess 510 is defined for receiving/mounting a light source at an angle to the horizontal, as best shown in FIG. 5E. FIG. 5B shows a font elevation view of the heat sink element 234 and FIG. 5C shows a side elevation view of the heat sink element 234. A sectional side view is provided by FIG. 5E.

It will be appreciated that tapered portions 520 are provided on opposite sides for the heat sink element 234 for engaging the retaining element (not shown). The tapered portions 520 further define a flange 312 for abuttingly engaging an end portion of the retaining element. The width 521 defined by the tapered portions is greater than the width 522 shown in the front elevation, such that when the body device is rotated 90 degrees the retaining element disengages the coupling element 312.

FIGS. 6A through 6L show the lens element 236 of a lighting assembly. The lower portion 610 of the lens element is adapted to conform with the exterior of the hand rail, when the body device is installed. The lens element is shown to be asymmetric with respect to a vertical plane 300, as best shown in FIG. 6H.

FIG. 6C shows a plan view of the lens element, FIG. 6D shows a side elevation view of the lens element, FIG. 6E shows an view from below the lens element, and FIG. 6F shows a front view of the lens element. Sectional views are provided in FIG. 6F and FIG. 6H.

Figure 7A:
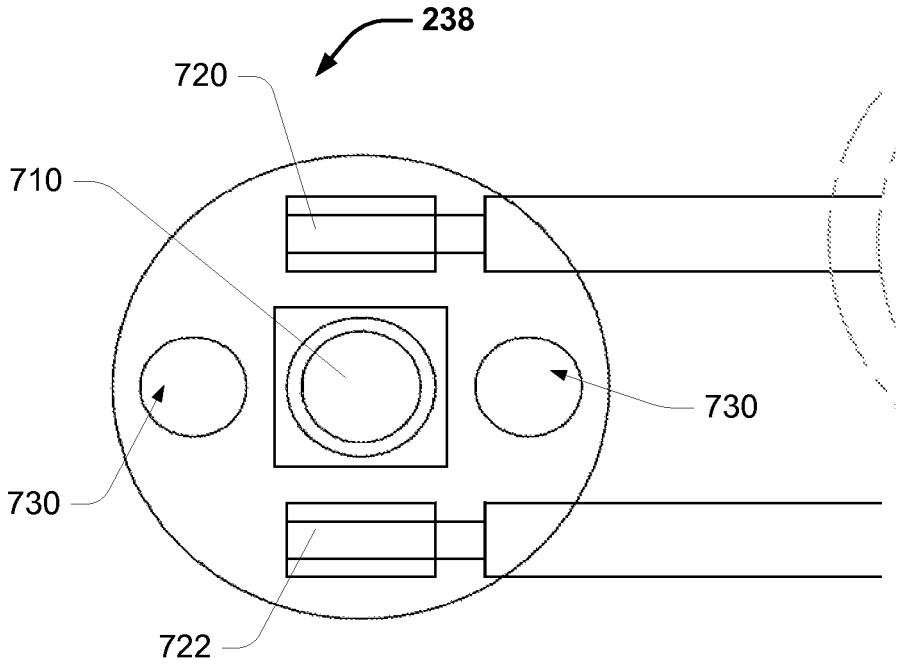
FIGS. 7A-7B show views of the light emitting diode (LED) light source of the lighting assembly of FIG. 2.
Figure 7B:
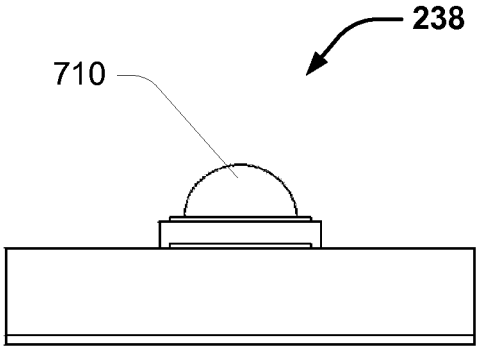

FIG. 7A and FIG. 7B show a plan and side elevation of the light emitting diode light source 328 respectively. The light source includes an LED component 710, electrical connections 720 and 722, and fitting apertures 730.

Figure 8A:
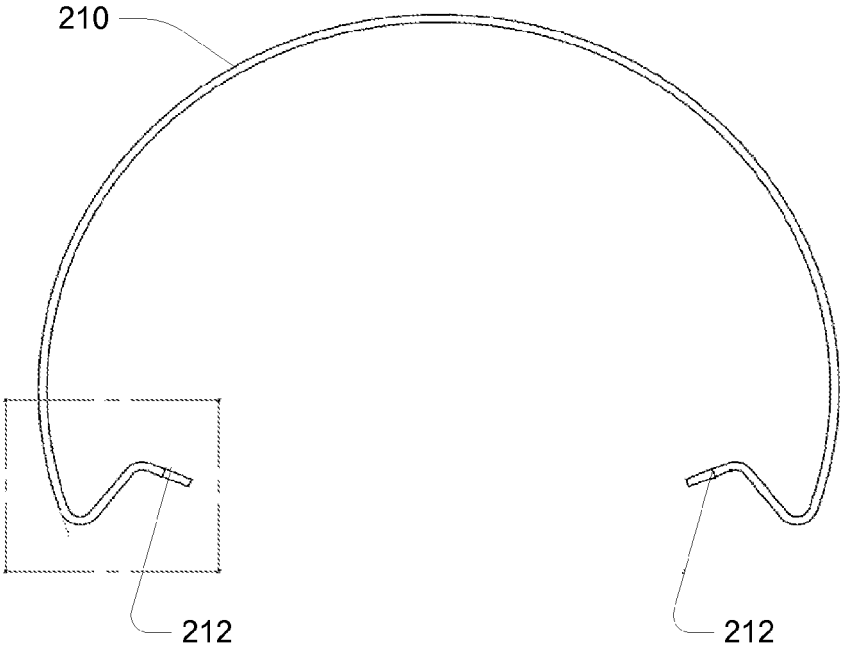
FIGS. 8A-8C show views of the retaining element of the lighting assembly of FIG. 2.
Figure 8B:
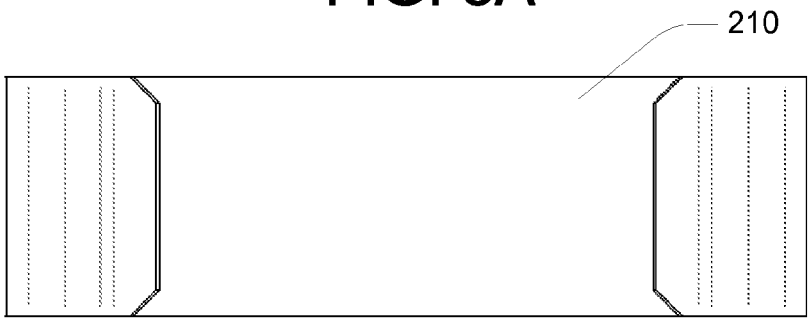
Figure 8C:
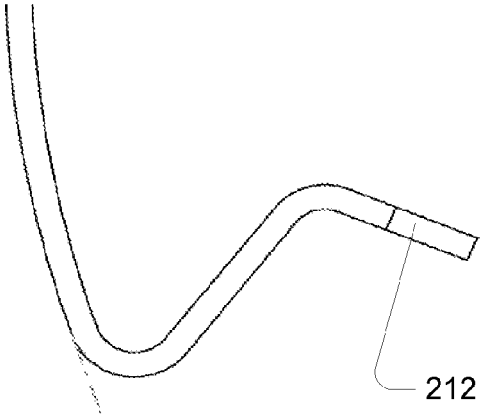

FIG. 8A through FIG. 8C show an elongate band retaining element 210. The retaining element further defines opposite end portions 212 adapted to engage the body device.

Figure 9:
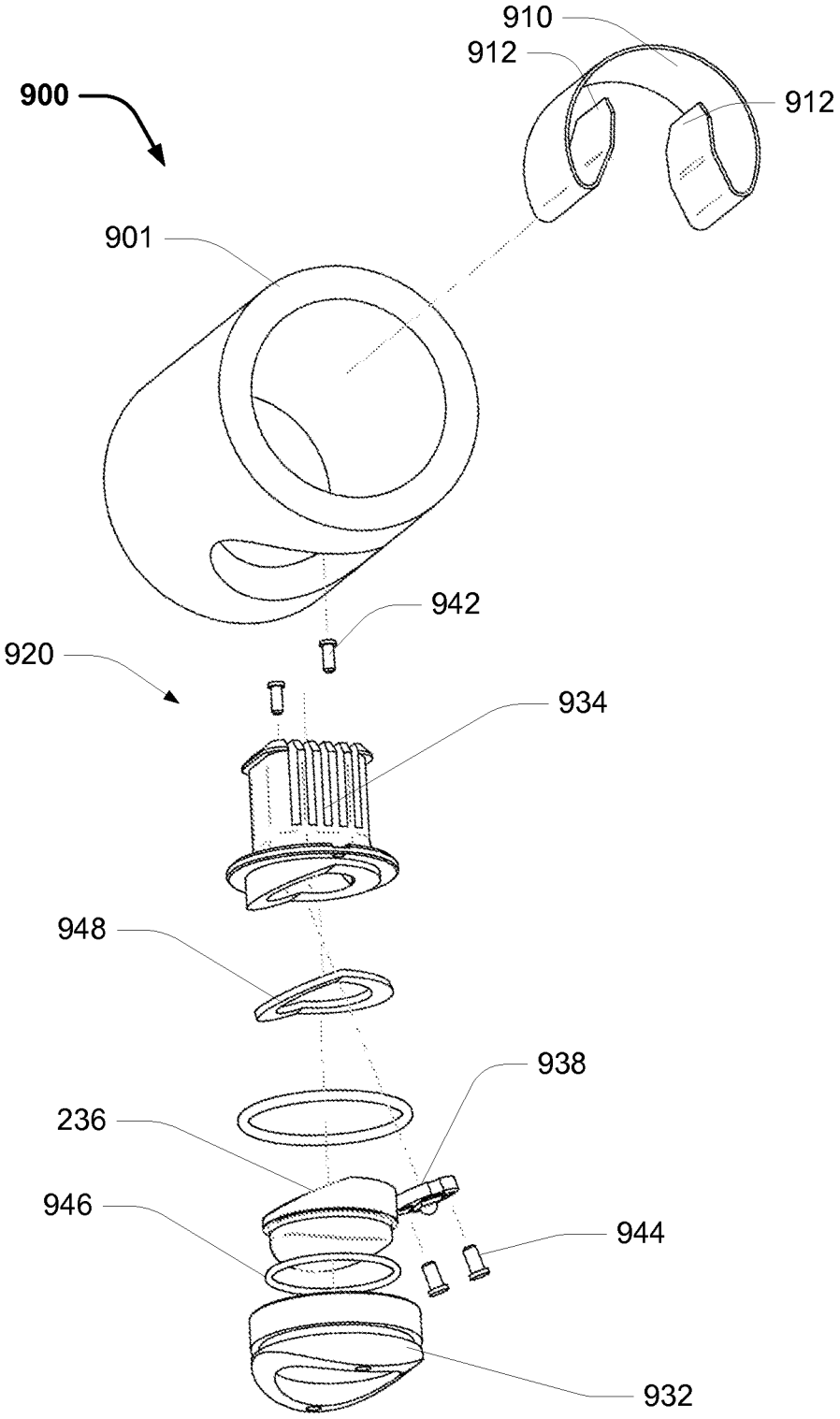
FIG. 9 is an inline assembly view of an embodiment lighting assembly according to the invention, shown installed in a hand rail.

FIG. 9 discloses an inline assembly view of an alternative embodiment lighting assembly 900. This lighting assembly is adapted for installation in a 40 mm diameter hand rail 901. This embodiment lighting assembly 900 includes a body device 920 for providing a light source, and a retaining element 910 comprising opposite end portions 912 for abuttingly engaging and retaining the body device.

The body device 920 comprises: a base element 932, a heat sink element 934, a lens element 936 and a light emitting diode (LED) light source 938. Detailed disclosure of these elements are provided in FIG. 11 through FIG. 14. The light emitting diode (LED) light source 238 is electrically coupled to a power source (not shown).

In this embodiment body device 920, the lens element 936 is adapted to be held within the base element 932, and the light source 938 is adapted to be held within the heat sink 934. The body device is then formed by fixing the heat sync to the base element with screws 942. It will be appreciated that the body devices 220 and 920 are each adapted to perform similar functions.

Figure 10A:
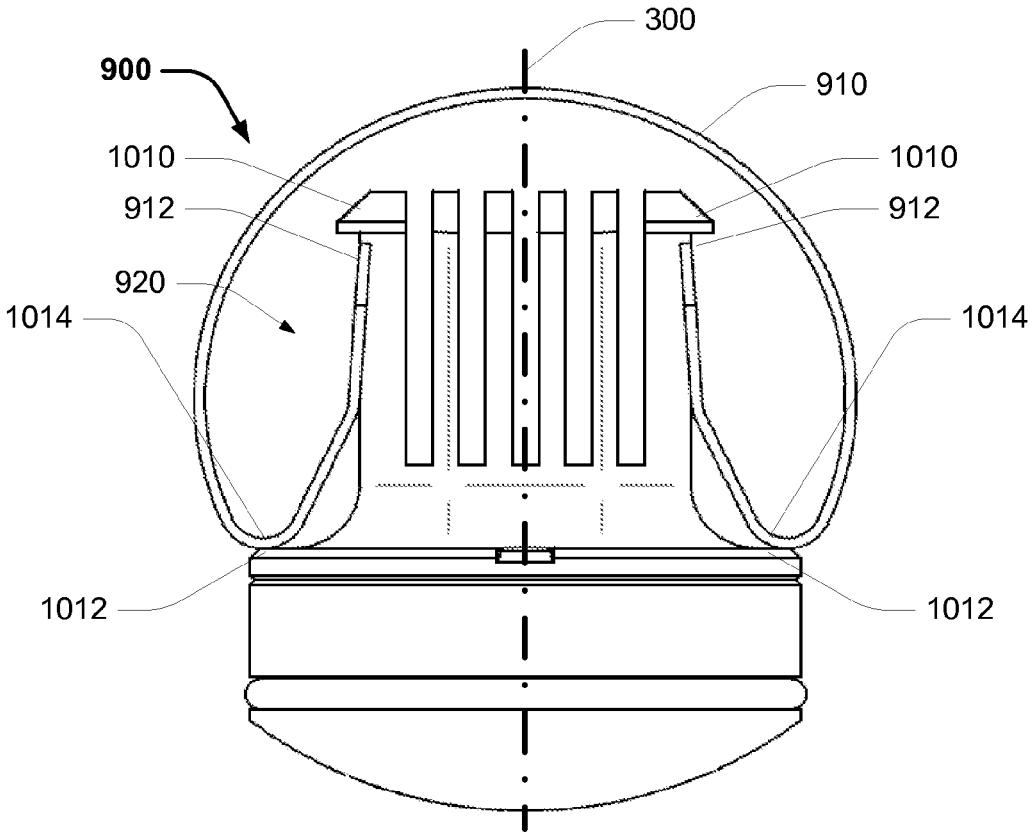
FIG. 10A is a side view of the lighting assembly of FIG. 9.
Figure 10B:
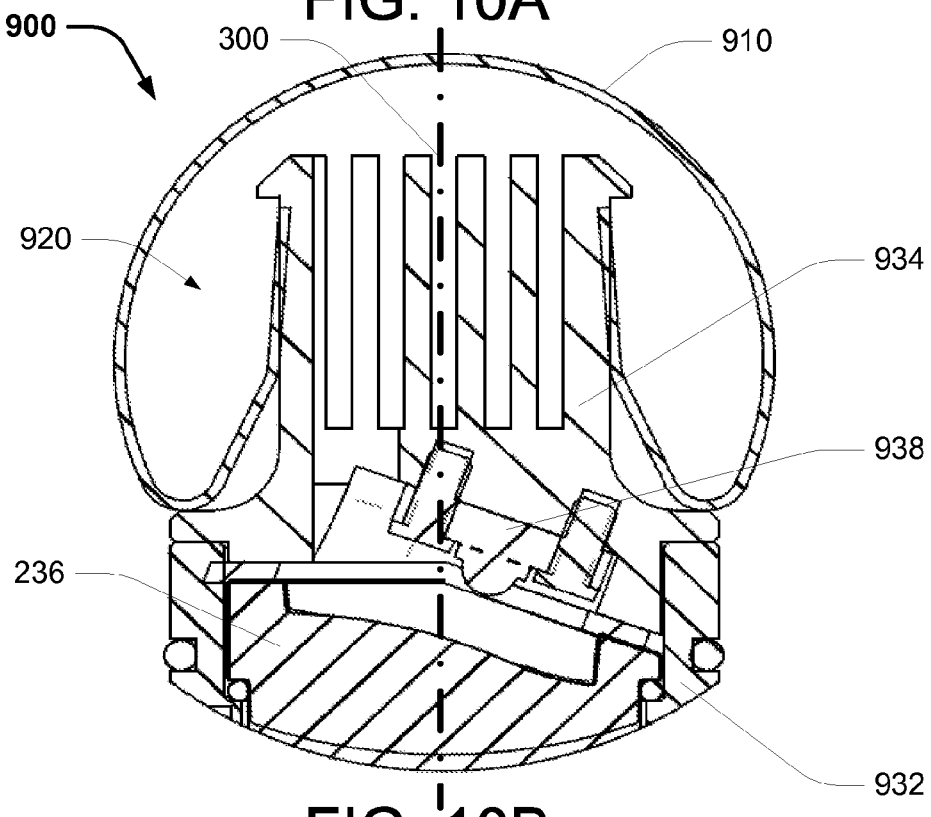
FIG. 10B is an sectional side view of the lighting assembly of FIG. 9.
Figure 11A:
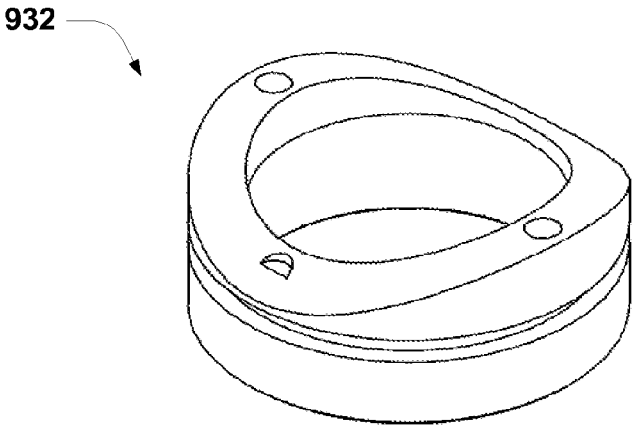
FIGS. 11A-11F show views of the base element of the lighting assembly of FIG. 9.
Figure 11E:
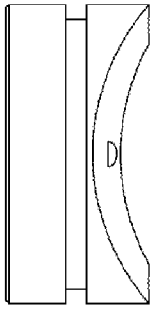
Figure 11B:
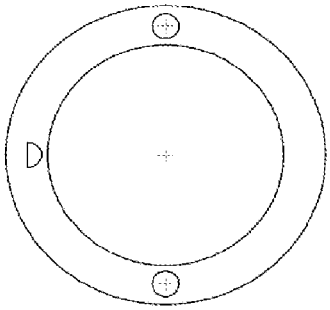
Figure 11F:
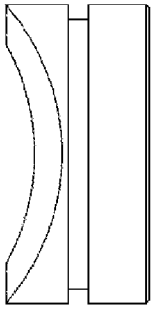
Figure 11C:
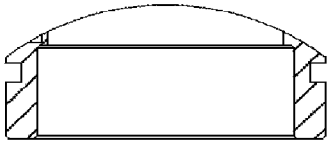
Figure 11D:
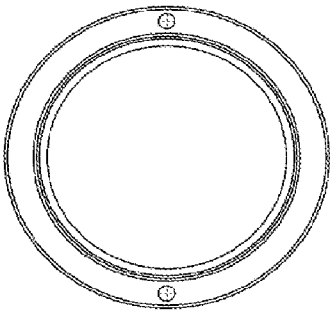
Figure 12A:
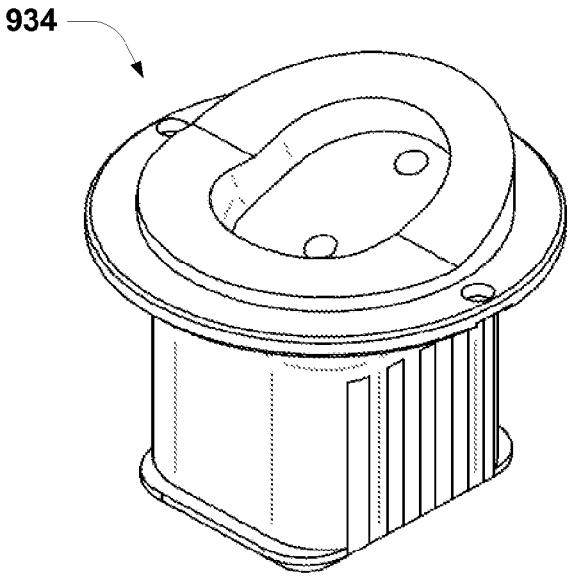
FIGS. 12A-12E show views of the heat sink element of the lighting assembly of FIG. 9.
Figure 12B:
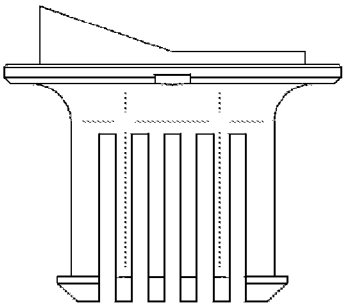
Figure 12C:
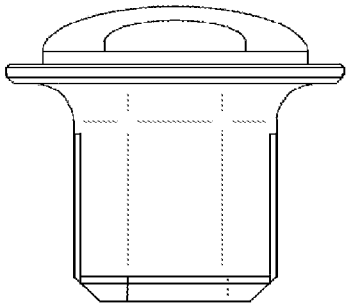
Figure 12D:
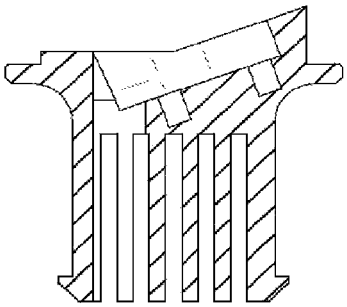
Figure 12E:
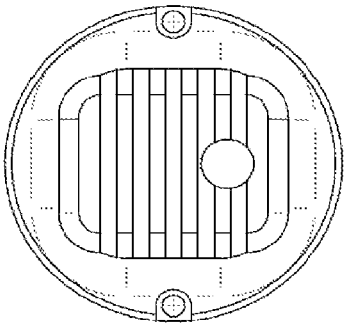
Figure 13A:
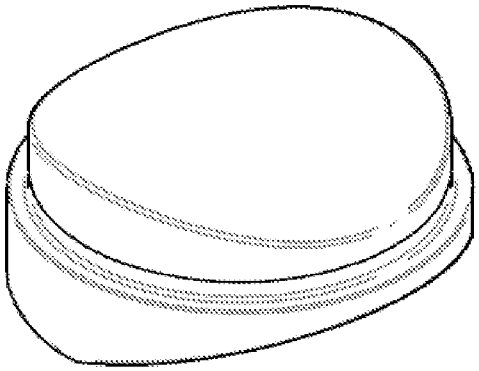
FIGS. 13A-13E show views of the lens element of the lighting assembly of FIG. 9.
Figure 13B:
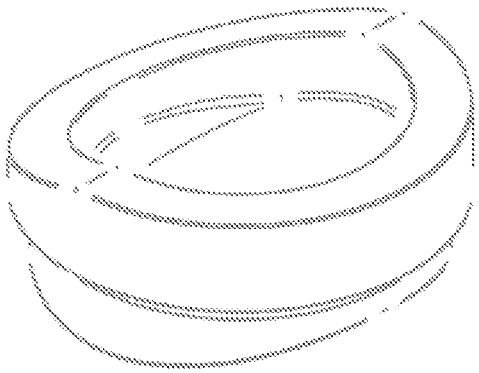
Figure 13C:
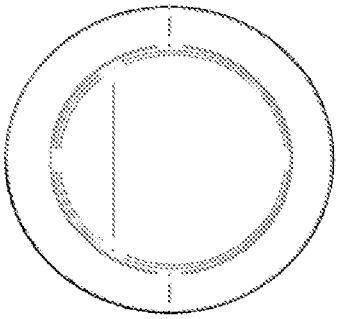
Figure 13E:
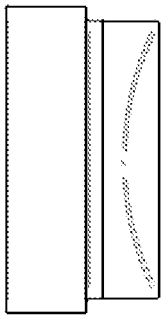
Figure 13D:
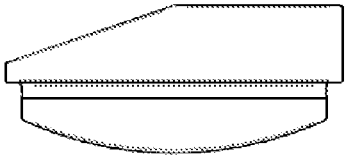

FIG. 10A shows a side view of the lighting assembly 900, with the retaining element 910 engaged to the body device 920. The retaining element has opposite end portions 912 for engaging the coupling element 1010. In this embodiment the coupling element is defined by a flange having a tapered leading edge, such that when the body device inserted through the fitting aperture the retaining element engages the coupling element. The opposite end portions 912 retain the body device within the hand rail (not shown). Upon insertion of the body device, the tapered flange 1010 directs the retaining element into an expanded configuration for receiving the body device, and enables return to the retaining configuration upon engagement with the coupling element. This restricts withdrawal of the body device from the hand rail.

In this embodiment, a stop abutment surface 1012 is also defined by the heat sink element 934 for restricting further entry of the body device through the fitting aperture. A portion of the retaining element 914 is adapted to engage the stop abutment surface 1012 to restrict further entry of the body device through the fitting aperture.

It would be appreciated that a stop means in an alternative embodiment can be provided for abutting a portion of either the retaining element or hand rail.

FIG. 11A through FIG. 11F show views of the base element 932.

FIG. 12A through FIG. 12E show views of the heat sink element 934.

FIG. 13A through FIG. 13E show views of the lens element 936.

Figure 14A:
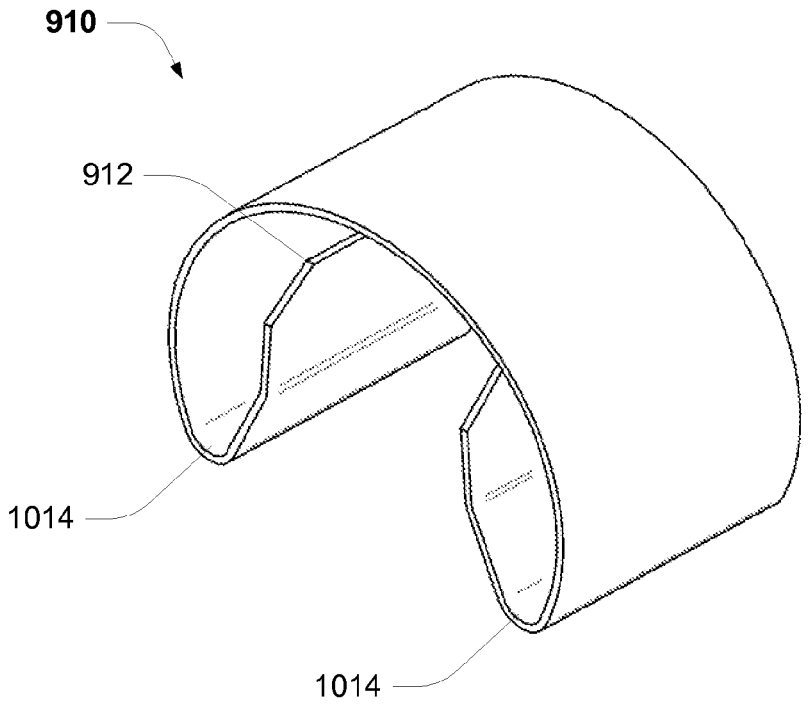
FIGS. 14A-14B shows the retaining element of the lighting assembly of FIG. 9.
Figure 14B:
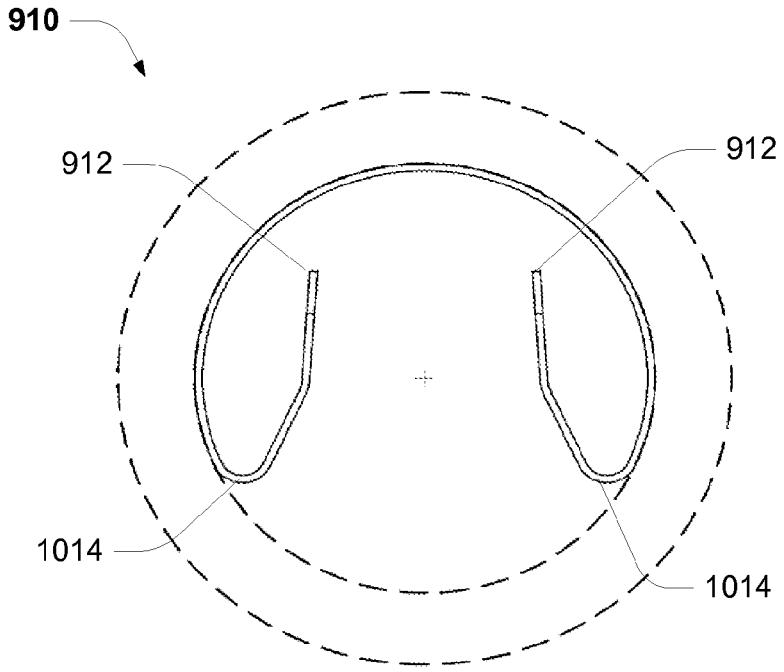

FIG. 14A through FIG. 14B shows views of the retaining element 910.

Figure 15:
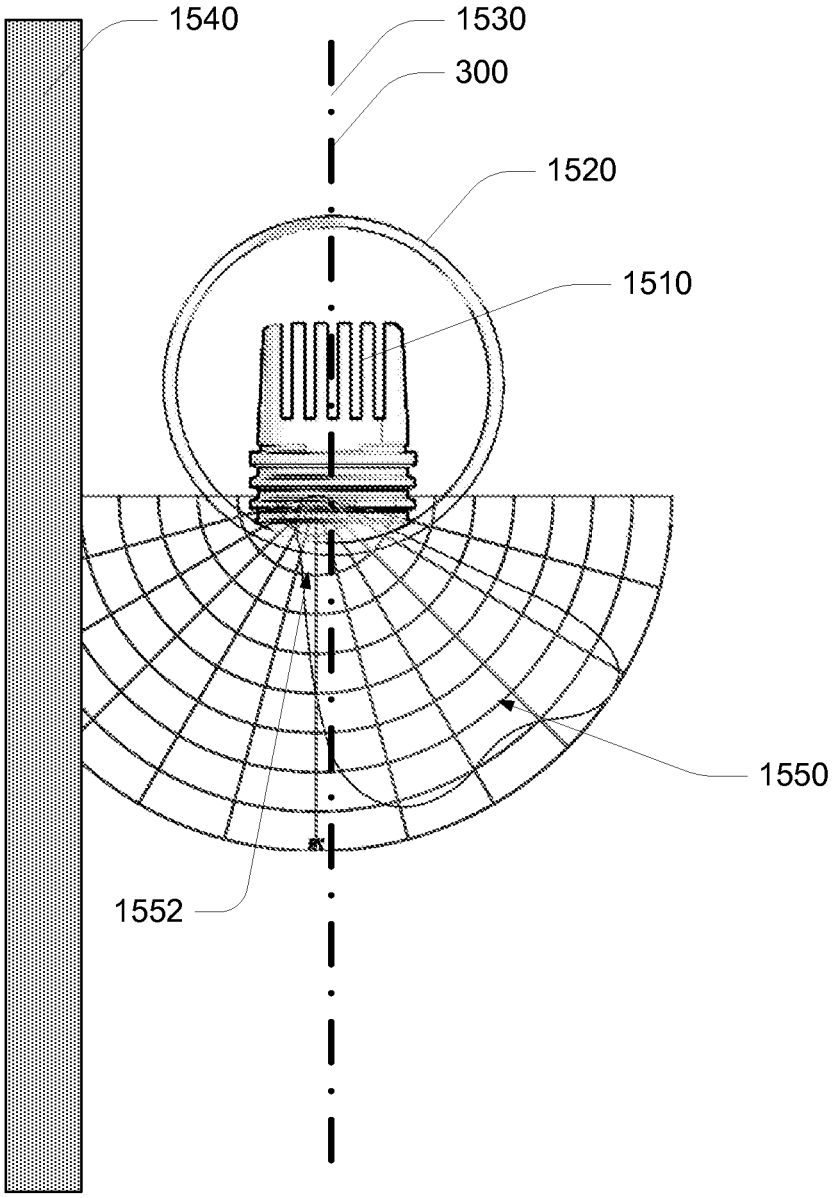
FIG. 15 is a data plot indicating side illumination intensity according to light direction.

Referring to FIG. 15, a body device 1510 is typically installed within a hand rail 1520 in a substantially downward orientation for directing light asymmetrically with respect to a vertical plane 1530 extending through the device. Typically, the body device is installed such that the vertical plane is parallel with the wall 1540 adjoining the hand rail 1520 for providing greater illumination 1550 toward a thoroughfare than illumination 1552 directed towards the wall.

Figure 16:
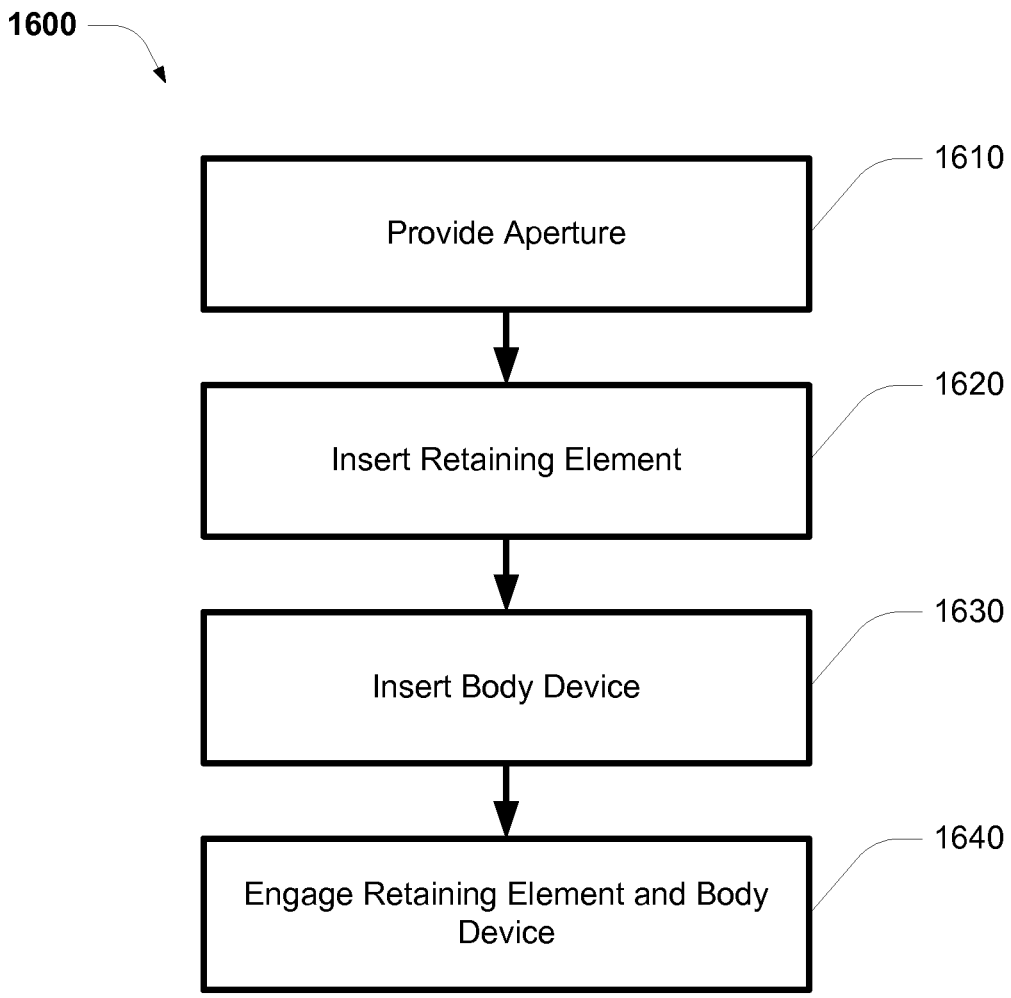
FIG. 16 is a flow chart for a method of installing a lighting assembly.

Referring to FIG. 16, a method for installing a lighting apparatus, including a separate body device and retaining element, in a hand rail includes:

STEP 1610 providing an installation aperture in the hand rail;

STEP 1620 inserting the retaining element through the aperture;

STEP 1630 linearly inserting of the body device through the aperture; and

STEP 1640 retaining element abuttingly engaging a coupling element of the body device.

Figure 17:
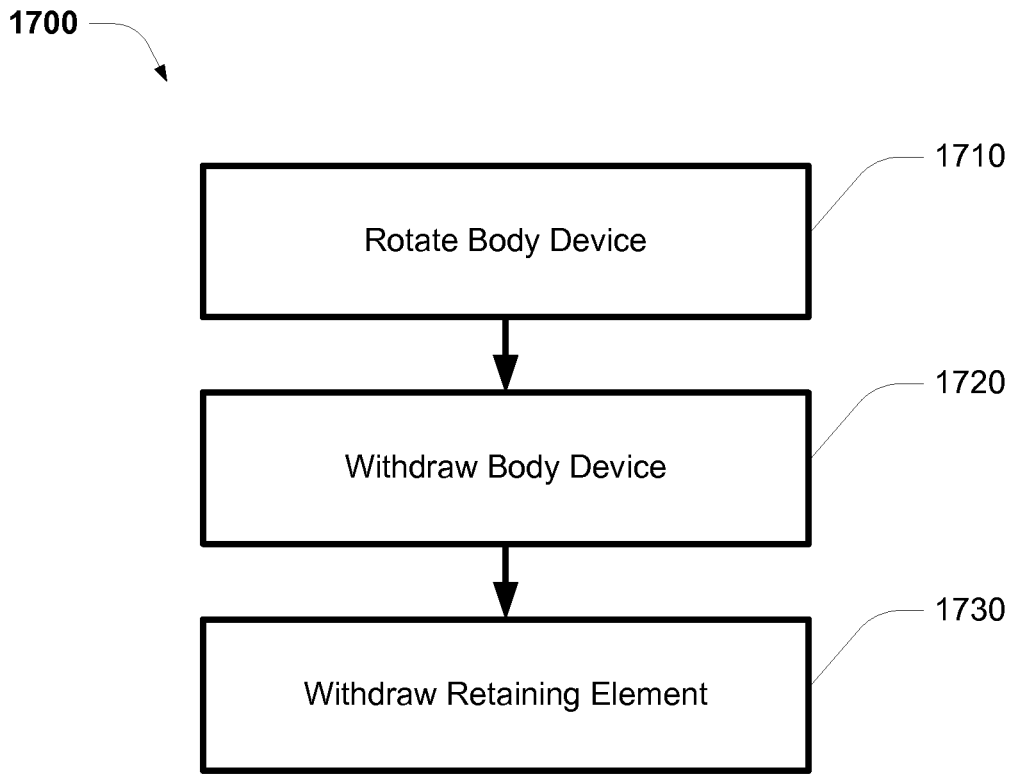
FIG. 17 is a flow chart for a method of removing a lighting assembly.

Referring to FIG. 17, a method of removing a lighting apparatus, including a separate body device and retaining element, from the hand rail can include:

STEP 1710 rotating the body device 90 degrees, to thereby disengage a retaining element from the coupling element;

STEP 1720 linearly withdrawing of the body device through the installation aperture;

STEP 1730 withdrawing the retaining element through the installation aperture (optional);

It will be appreciated that the illustrated lighting assembly can be installed into a handrail. It will be further appreciated that the illustrated lighting assembly, when installed in a handrail, provides directed illumination. Wherein, this lighting assembly can directs light toward a thoroughfare and away from a wall adjoining the handrail.

It will be appreciated that the illustrated lighting assembly can be retrofitted into an exiting handrail.

Although the invention has been described with reference to specific examples, it will be appreciated by those skilled in the art that the invention may be embodied in many other forms.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

In the claims below and the description herein, any one of the terms comprising, comprised of or which comprises is an open term that means including at least the elements/features that follow, but not excluding others. Thus, the term comprising, when used in the claims, should not be interpreted as being limitative to the means or elements or steps listed thereafter. For example, the scope of the expression a device comprising A and B should not be limited to devices consisting only of elements A and B. Any one of the terms including or which includes or that includes as used herein is also an open term that also means including at least the elements/features that follow the term, but not excluding others. Thus, including is synonymous with and means comprising.

Similarly, it is to be noticed that the term coupled, when used in the claims, should not be interpreted as being limitative to direct connections only. The terms "coupled" and "connected", along with their derivatives, may be used. It should be understood that these terms are not intended as synonyms for each other. Thus, the scope of the expression a device A coupled to a device B should not be limited to devices or systems wherein an output of device A is directly connected to an input of device B. It means that there exists a path between an output of A and an input of B which may be a path including other devices or means. "Coupled" may mean that two or more elements are either in direct physical, or that two or more elements are not in direct contact with each other but yet still co-operate or interact with each other.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

As used herein, unless otherwise specified the use of terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader, or with reference to the orientation of the structure during nominal use, as appropriate. Similarly, the terms "inwardly" and "outwardly" generally refer to the orientation of a surface relative to its axis of elongation, or axis of rotation, as appropriate.

Similarly it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

In the description provided herein, numerous specific details are set forth. However, it is understood that embodiments of the invention may be practiced without these specific details.

In other instances, well-known methods, structures and techniques have not been shown in detail in order not to obscure an understanding of this description.

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

It will be appreciated that an embodiment of the invention can consist essentially of features disclosed herein. Alternatively, an embodiment of the invention can consist of features disclosed herein. The invention illustratively disclosed herein suitably may be practiced in the absence of any element which is not specifically disclosed herein.

The claims defining the invention are as follows:

1. A lighting assembly for installing through a fitting aperture defined by a handrail, the fitting aperture defining a linear axis of insertion that is transverse to a longitudinal axis of the handrail, the lighting assembly including:

a retaining element that is removably insertable through the fitting aperture;

a body device for providing a light source, the body device comprising a coupling element releasably engageable to the retaining element;

wherein, with the retaining element inserted through the fitting aperture and located within the handrail, insertion of the body device along the linear axis of insertion through the fitting aperture enables the coupling element to engage the retaining element thereby releasably retaining the body device, and wherein the body device is configured to be disengaged from the retaining element by relative rotation of the body device with respect to the retaining element and/or handrail about the linear axis of insertion, thereby enabling removal of the body device from the handrail, and wherein with the body device disengaged from the retaining element by relative rotation of the body device with respect to the retaining element and/or handrail about the linear axis of insertion, a stop restricts further entry of the body device through the fitting aperture.

2. The lighting assembly according to claim 1, wherein:

with the body device inserted through fitting aperture and retained by the retaining element, the light source provides an asymmetric illumination pattern.

3. The lighting assembly according to claim 1, wherein:

the lighting assembly directs light asymmetrically about the linear axis of insertion, such that with the body device installed in a handrail in a substantially downward orientation, the light source is asymmetrically directed toward a thoroughfare and away from a wall adjoining the handrail.

4. The lighting assembly according to claim 1, wherein the body device comprises: a base element; a heat sink element; a light emitting diode light source; and a lens element.

5. The lighting assembly according to claim 4, wherein:

the body device is formed by fixing the heat sink element to the base element;

the lens element being adapted to be located with the base; and the light source being adapted to be located with the heat sink element.

6. The lighting assembly according to claim 4, wherein the light source is mounted at an angle offset to the linear axis of insertion.

7. The lighting assembly according to claim 4, wherein the linear axis of insertion is defined through a center of both the base and the heat sink when viewed as a side profile.

8. The lighting assembly according to-claim 1, wherein the retaining element is biased into a retaining configuration.

9. The lighting assembly according to-claim 1, wherein the retaining element is elongate and sized to circumferentially abut a portion of an interior of the handrail.

10. The lighting assembly according to-claim 1, wherein:

the coupling element is defined by a pair of groves on opposite sides of the body device for providing an abutment surface for engaging the retaining element and thereby retaining the body device.

11. The lighting assembly according to-claim 1, wherein:

the body device is configured to be disengaged from the retaining element by rotating the body device 90 degrees with respect to the retaining element and/or handrail about the linear axis of insertion.

12. The lighting assembly according to-claim 1, wherein:

with the body device installed in the handrail, the linear axis of insertion is substantially vertical.

13. A lighting assembly for installing through a fitting aperture defined by a handrail, the lighting assembly including:

a retaining element that is removably insertable through the fitting aperture;

a body device for providing a light source, the body device comprising a coupling element releasably engageable to the retaining element; and wherein, with the retaining element inserted through the fitting aperture and located within the handrail, insertion of the body device through the fitting aperture enables the coupling element to engage the retaining element thereby releasably retaining the body device, wherein:

the body device comprises: a base element a heat sink element a light emitting diode light source; and a lens element, wherein the lens element is asymmetric with respect to an axis of insertion, and directs light asymmetrically about the axis;

such that with the body device is installed in a handrail in a substantially downward orientation, the lens element directs light asymmetrically toward a thoroughfare and away from a wall adjoining the handrail.

14. A lighting assembly for installing through a fitting aperture defined by a handrail, the lighting assembly including:

a retaining element that is removably insertable through the fitting aperture;

a body device for providing a light source, the body device comprising a coupling element releasably engageable to the retaining element; and wherein, with the retaining element inserted through the fitting aperture and located within the handrail, insertion of the body device through the fitting aperture enables the coupling element to engage the retaining element thereby releasably retaining the body device, wherein:

opposite end portions of the retaining element each abuttingly engage an abutment surface defined by the coupling element for retaining the body device; and the opposite end portions each abuttingly engage a stop for restricting further entry of the body device through the fitting aperture.

15. A lighting assembly for installing through a fitting aperture defined by a handrail, the lighting assembly including:

a retaining element that is removably insertable through the fitting aperture;

a body device for providing a light source, the body device comprising a coupling element releasably engageable to the retaining element; and wherein, with the retaining element inserted through the fitting aperture and located within the handrail, insertion of the body device through the fitting aperture enables the coupling element to engage the retaining element thereby releasably retaining the body device, wherein:

the coupling element is defined by a pair of flange protrusions on opposite sides of the body device, and the body device has an expanding taper for directing the retaining element into an expanded configuration for receiving the body device, and enabling a retaining configuration upon engagement with the coupling element.

16. A lighting assembly for installing through a fitting aperture defined by a handrail, the lighting assembly including:

a retaining element that is removably insertable through the fitting aperture;

a body device for providing a light source, the body device comprising a coupling element releasably engageable to the retaining element; and wherein, with the retaining element inserted through the fitting aperture and located within the handrail, insertion of the body device through the fitting aperture enables the coupling element to engage the retaining element thereby releasably retaining the body device, wherein:

the body device includes a stop for restricting further entry of the body device through the fitting aperture;

the stop is adapted to abuttingly engage opposite end portion of the retaining element; and the stop being further adapted to restrict movement of the body device, when the body device is substantially flush with the exterior of the handrail.

* * * * *

UNITED STATES PATENT AND TRADEMARK OFFICE

CERTIFICATE OF CORRECTION

PATENT NO. : 9,206,953 B2
APPLICATION NO. : 13/807525
DATED : December 8, 2015
INVENTOR(S) : Roos It is certified that error appears in the above-identified patent and that said Letters Patent is hereby corrected as shown below:

In the specification

| | | |
|---|---|---|
| Column 2, line 45, "abuttingly engages" | should read | --abuttingly engage-- |
| Column 3, line 22, "an light" | should read | --a light-- |
| Column 3, line 44, "is in installed" | should read | --is installed-- |
| Column 4, line 27, "is an sectional" | should read | --is a sectional-- |
| Column 4, line 35, "FIGS. 14A-14B shows" | should read | --FIGS. 14A-14B show-- |
| Column 5, line 1, "an light" | should read | --a light-- |
| Column 5, lines 23-24, "with 50.8 mm" | should read | --with a 50.8 mm-- |
| Column 5, line 42, "to the a heat" | should read | --to a heat-- |
| Column 5, line 52, "the lens can directs" | should read | --the lens directs-- |
| Column 5, line 66, "is in installed" | should read | --is installed-- |
| Column 6, line 6, "insertion substantially" | should read | --insertion is substantially-- |
| Column 6, line 23, "can directs light" | should read | --directs light-- |
| Column 6, line 26, "angle of the 238" | should read | --angle of the light source 238-- |
| Column 6, line 45, "orientates" | should read | --orientated-- |

Signed and Sealed this
Twenty-first Day of June, 2016

Michelle K. Lee

Michelle K. Lee
*Director of the United States Patent and Trademark Office*

In the specification

| | | |
|---|---|---|
| Column 6, line 51, “235 heat sink” | should read | --235 and heat sink-- |
| Column 6, line 56, “210 engages” | should read | --210 engage-- |
| Column 6, line 59, “that an alternative coupling element can” | should read | --that alternative coupling elements can-- |
| Column 7, line 1, “engages the” | should read | --engage the-- |
| Column 7, line 8, “surface of opposite” | should read | --surfaces of opposite-- |
| Column 7, line 21, “being a sustainably cylindrical” | should read | --being substantially cylindrical-- |
| Column 7, line 25, “shows a font” | should read | --shows a front-- |
| Column 7, line 37, “shows a font” | should read | --shows a front-- |
| Column 7, line 58, “shows an view” | should read | --shows a view-- |
| Column 8, line 11, “elements are” | should read | --elements is-- |
| Column 8, line 27, “device inserted” | should read | --device is inserted-- |
| Column 9, line 1, “inserting of the” | should read | --inserting the-- |
| Column 9, line 19, “assembly can directs” | should read | --assembly directs-- |
| Column 10, line 41, | delete | --the new paragraph indentation, and restore the sentence to the previous paragraph-- |

In the claims

| | | |
|---|---|---|
| Claim 2, column 11, line 24, “through fitting” | should read | --through the fitting-- |
| Claim 8, column 11, line 50, “to-” | should read | --to-- |
| Claim 9, column 11, line 52, “to-” | should read | --to-- |
| Claim 10, column 11, line 55, “to-” | should read | --to-- |
| Claim 10, column 11, line 56, “groves on” | should read | --grooves on-- |

In the claims

| | | |
|---|---|---|
| Claim 11, column 11, line 60, “to-” | should read | --to-- |
| Claim 12, column 11, line 65, “to-” | should read | --to-- |
| Claim 13, Column 12, line 15-16, “a base element a heat sink element” | should read | --a base element; a heat sink element;-- |
| Claim 13, column 12, line 19, “device is installed” | should read | --device installed-- |
| Claim 16, column 13, line 12, “engage opposite” | should read | --engage the opposite-- |